US010287832B2

(12) United States Patent
Cordes et al.

(10) Patent No.: US 10,287,832 B2
(45) Date of Patent: May 14, 2019

(54) TONG SYSTEM FOR USE ON A DRILLING INSTALLATION AND CLAMPING BLOCK OF SUCH A TONG SYSTEM

(71) Applicant: BENTEC GMBH DRILLING & OILFIELD SYSTEMS, Bad Bentheim (DE)

(72) Inventors: Malte Cordes, Rheine (DE); Heiko Schmidt, Munster (DE); Andre Reuter, Gronau-Epe (DE)

(73) Assignee: BENTEC GMBH DRILLING & OILFIELD SYSTEMS, Bad Bentheim (DE)

( * ) Notice: Subject to any disclaimer, the term of this patent is extended or adjusted under 35 U.S.C. 154(b) by 256 days.

(21) Appl. No.: 15/307,799

(22) PCT Filed: Apr. 25, 2015

(86) PCT No.: PCT/EP2015/058996
§ 371 (c)(1),
(2) Date: Jan. 23, 2017

(87) PCT Pub. No.: WO2015/165832
PCT Pub. Date: Nov. 5, 2015

(65) Prior Publication Data

US 2017/0167209 A1 Jun. 15, 2017

(30) Foreign Application Priority Data

Apr. 29, 2014 (DE) ..... 10 2014 208 113

(51) Int. Cl.
*E21B 19/16* (2006.01)

(52) U.S. Cl.
CPC ..... *E21B 19/163* (2013.01)

(58) Field of Classification Search
CPC ..... E21B 19/161; E21B 19/163; E21B 19/164
(Continued)

(56) References Cited

U.S. PATENT DOCUMENTS 3,806,021 A * 4/1974 Moroz ..... B23K 37/0533 228/4.1
6,971,283 B2 * 12/2005 Belik ..... B25B 5/147 81/186

(Continued)

FOREIGN PATENT DOCUMENTS

| | | |
|---|---|---|
| CA | 2520927 | 3/2007 |
| DE | 19812958 | 12/2004 |
| EP | 0130450 | 9/1986 |

OTHER PUBLICATIONS

Germany Search Report of Counterpart DE Application No. 10 2014 208 113.0.

*Primary Examiner* — Hadi Shakeri
(74) *Attorney, Agent, or Firm* — Liu & Liu

(57) ABSTRACT

The invention relates to a tong system for connecting a drill rod element (12) to an often stationary drill rod element (12) or for disconnecting a drill rod element from another drill rod element (12), wherein the tong system comprises at least two clamping blocks (20, 22), which face each other and are intended to fasten the tong system to the stationary drill rod element (12), and wherein at least one clamping block (20, 22) comprises movable means (30, 32) having a centering contour, which movable means (30, 32) are effective for adjusting the tong system in relation to the stationary drill rod element (12). The invention further relates to a clamping block (20, 22) as a component of such a tong system.

15 Claims, 11 Drawing Sheets

(58) Field of Classification Search
USPC ..... 81/57.33
See application file for complete search history.

(56) References Cited

U.S. PATENT DOCUMENTS

| | | | | |
|---|---|---|---|---|
| 7,997,167 | B2 * | 8/2011 | Kruse | E21B 19/161 81/57.34 |
| 8,496,238 | B1 * | 7/2013 | Orgeron | B25B 5/061 269/218 |
| 8,601,911 | B1 * | 12/2013 | Baryam | B25B 13/52 81/57.15 |
| 2005/0056122 | A1 | 3/2005 | Belik | |
| 2005/0076744 | A1 | 4/2005 | Pietras et al. | |
| 2007/0068669 | A1 * | 3/2007 | Lesko | E21B 19/163 166/77.51 |
| 2011/0030970 | A1 | 2/2011 | Tweedie et al. | |

* cited by examiner

TONG SYSTEM FOR USE ON A DRILLING INSTALLATION AND CLAMPING BLOCK OF SUCH A TONG SYSTEM

BACKGROUND OF THE INVENTION

Field of the Invention

The invention relates to a tong system provided for use in a drilling rig for deep drilling, for example for sinking holes over hydrocarbon deposits for oil and gas exploration or for geothermal development, which in the professional terminology frequently is also termed a "floorhand" or an "iron roughneck," and also can be termed an automatic rod tong.

Description of the Related Art

U.S. 2007/068669 A describes such a tong system. The invention also relates to a clamping block of such a tong system.

A generic tong system is provided when mounting and dismounting the drill rod for connecting two drill rod elements or for disconnecting two drill rod elements, in particular for connecting one drill rod element to the drill string or to release a drill rod element from a drill string. For this purpose the tong system is moved by means of a movable arm or the like in the region above the borehole or a region above the so-called mouse hole. There a drill rod element is connected to a stationary drill rod element or a drill rod element is separated from a stationary drill rod element. The stationary drill rod element is for example stationary as a component of the drill string or because of placement in the mouse hole. For better readability—but without dispensing with further general validity—the following description is continued with reference to a stationary drill rod element as a component of the drill string and use of the tong system over the borehole.

By means of a lower tong included in the tong system, in a manner known per se first the tong system is fixed to the stationary drill rod element. By means of an upper tong that is movable in relation to the lower tong, then—in a manner likewise known per se—either connection of a further drill rod element to the stationary drill rod element or disconnection of the drill rod element from the stationary drill rod element occurs.

In the process, precise positioning of the tong system above the stationary drill rod element is important.

SUMMARY OF THE INVENTION

The description applies equally to a drill rod element whose stationary nature follows from its placement in the mouse hole and a use of the tong system over the mouse hole is accordingly to be read into every mention of an application of the tong system over the borehole. Basically a tong system of the type recommended here is also usable at other points of the drill rig and is suitable for every use when connecting or disconnecting a threaded connection of two elements with a round cross-section at least in part.

An objective of the present invention accordingly is to provide an efficient, low-wear and low-maintenance capability for positioning of the tong system over the stationary drill rod element.

The above problem is solved according to the invention with a tong system with the features of claim 1 as well as a clamping block with the features of the second independent claim. For this purpose for a tong system for connecting a drill rod element to a stationary drill rod element or for disconnecting a drill rod element from a stationary drill rod element it is provided that the tong system comprises at least two clamping blocks that face one another and are provided for fixing the tong system to the stationary drill rod element, and that at least one clamping block comprises movable means have a centering contour, which movable means are effective for adjusting the tong system in relation to the stationary drill rod element. Here the or each means provided for adjusting the tong system in relation to the stationary drill rod element, for example a cover plate of the clamping block, has a central notch and two side lugs. Using the side lugs it is possible during centering to ensure the motion of the tong system in relation to the stationary drill rod element in such a way that the drill rod element is in the region of the central notch at the end of centering. In a special embodiment said means, for example a cover plate of the clamping block, has two side lugs in the form of lugs connected integrally to means that function as carrier.

In the initially named U.S. 2007/068669 A, the clamping blocks function as means for adjusting the tong system in relation to the stationary drill rod element. In this way an adjustment is possible only in the direction of the axis, along which the two clamping blocks move toward one another, for example in such a way that after initial positioning of the tong system too far to the right from the stationary drill rod element, the tong system is adjusted in the opposite direction. The same applies to DE 198 12 958 B as well as EP 0 130 450 B which were obtained by the German Patent and Trademark Office during the search concerning the underlying German patent application. In DE 198 12 958 B, a drill rod element is fixed by means of two clamping blocks (clamping jaws), of which one is stationary and the other is axially translationally movable. The clamping blocks/clamping jaws have a contour for gripping the drill rod element.

However, the clamping blocks/clamping jaws therein have no means that are movable in relation to the respective clamping block and are effective for adjusting a tong system. Also in EP 0 130 450 B at most the contour, by means of which the clamping jaw units therein grip the drill rod element, is effective for adjustment. But here also there is no means—in comparison with the approach suggested here—having a centering contour that are movable in relation to at least one clamping block and are effective for adjusting the tong system in relation to the stationary drill rod element. CA 2 520 927 A1 discloses a clamping block of the above type. The clamping block's gripping surface is constituted on the front face of a component inserted form-fittingly into a recess. The said recess and the borderline contour of the said component are dimensioned with respect to each other to allow a certain movability of the component. In this respect the said component as well as the front facing gripping surface is moveable with respect to the clamping block.

In the approach suggested here, the clamping block does not function or at least does not solely function as the means for adjusting the tong system. Rather it is provided that at least one clamping block comprises movable means that are effective for adjusting the tong system in relation to the stationary drill rod element, namely for example a cover plate or an upper and a lower cover plate of the clamping block with a centering contour formed therein of the above-described type. Hereby adjustment of the tong system, in particular of a tong system with in each case precisely two clamping blocks facing one another, is also possible in a transverse direction to the axis of motion of the clamping blocks. Due to the mobility, an adjustment to the position and/or the motion of the clamping blocks is possible.

The advantage of the concept recommended here lies primarily in the fact that by means of the centering contour comprised by at least one clamping block and movably arranged therein, an adjustment of the tong system in relation to a stationary drill rod element, which below may occasionally also just be termed centering, is also possible in a direction that is vertical to the axis of motion of the clamping blocks. Upon approach of the clamping blocks that face one another and which are provided for fixing the tong system to the stationary drill rod element, centering of the tong system occurs with respect to the drill rod element in the direction of the axis of motion of the clamping blocks. At the same time, by means of the centering contour, centering of the tong system also occurs with respect to a direction vertical thereto. As a result, complete centering of the tong system in relation to the stationary drill rod element is achieved.

Advantageous embodiments of the invention are the subject matter of the dependent claims. The references used herein refer to the further development of the subject matter of the independent claim by the features of the respective dependent claim. These should not be understood as renouncing the attainment of independent objective protection for the feature combinations of the related dependent claims. Further, with respect to an interpretation of the claims in a detailed specification of the feature in a subordinate claim, it must be assumed that such a restriction is not present in the respective preceding claims.

In one embodiment of the tong system, the centering contour side lugs on one side of the central notch have a long lug with an arcuate edge contour and a short lug with an arcuate edge contour, wherein a radius of the ark-like edge contour of the long lug is smaller than the radius of the arc-like edge contour of the short lug. The short lug of the centering contour faces an opening of the operating region of the tong system. The long lug is thus in the rear part of the operating region of the tong system. The short lug thus opens up the opening of the tong system as widely as possible. The long lug with the sharper arcuate-like edge contour is able to grasp a drill rod element and to allow subsequent centering even if the tong system is already brought relatively close to the drill rod element.

In yet another embodiment of the tong system the or each means provided for adjusting the tong system in relation to the stationary drill rod element is translationally movable in relation to the clamping block. Such mobility alternatively comes into question for a basically likewise possible rotational mobility. A translational mobility allows a structurally comparatively simple design of the clamping block and thus facilitates its manufacture, installation, and maintenance.

For an embodiment of the tong system with translationally movable means for adjusting the tong system, at least one translationally movable cover plate of the clamping block functions as such a means. Use of such a cover plate as means for adjusting the tong system has the advantage that a translational mobility of the cover plate of the clamping block, thus of an outside part, may be implemented in a structurally comparatively simple manner, for example by means of a linear sliding guide and at least one guide contour formed in the clamping block and a guide counter-contour engaging in the latter on or in the cover plate in a form-fitting manner. In this regard, such a cover plate, for example because of wear of the centering contour formed therein, may be replaced; this can be removed like a housing cover on the clamping block, so that simplification of possible repair and/or maintenance measures results.

While the or each cover plate or each other means for adjusting the tong system is spring-mounted, the result is a self-acting coordination of the adjustment of the tong system in the direction vertical to the direction of motion of the clamping blocks with the adjustment of the tong system in the direction of motion of the clamping blocks. After a first grasp of the stationary pipe rod element by means of the centering contour, in the or each cover plate, the centering contour remains in continuous contact with individual sections of the outer surface of the grasped section of the drill rod element even during further closure of the clamping blocks facing one another. The closer the clamping blocks come to one another, thus also effecting an adjustment of the tong system in the direction of motion of the clamping blocks, the more the or each spring-mounted cover plate retreats until finally there is contact of the gripping surfaces of the clamping blocks with the outer surface of the grasped section of the pipe rod element, and the tong system then adjusted in relation to the stationary drill rod element is fixed to the drill rod element. The spring force of the spring mounting of the or each cover plate is hereby selected such that the intended adjustment of the tong system in relation to the stationary pipe rod element is possible.

While in a special embodiment of the tong system, each clamping block for fixing the tong system to the stationary drill rod element has two cover plates functioning as means for adjusting the tong system, i.e. an upper and a lower cover plate, the intended adjustment of the tong system in relation to the stationary drill rod element can also be carried out when the drill rod element is gripped in a region with different diameters, because then each cover plate with the centering contour, independently of the other cover plate and its centering contour, attacks the respectively grasped section of the drill rod element and its outer surface according to the respective diameter.

In a further embodiment of the tong system, each cover plate has the centering contour in two planes. A sequence of the planes of the centering contour in the two cover plates of one of the two clamping blocks facing one another as well as a sequence of the planes of the centering contour in the two cover planes of the opposite clamping block is thereby selected such that a positive-fit connection of the planes of the centering contours of the cover plates of the other clamping block is possible. In this manner the two clamping blocks facing one another are brought further together than would be possible without such an embodiment. Despite the centering contours, accordingly by means of the tong system a drill rod element with a very small diameter can be safely gripped.

In yet a further embodiment of the tong system with two clamping blocks with in each case two cover plate types, as means for adjusting the tong system, for the first clamping block one cover plate of a first cover plate type functions as an upper cover plate, and one cover plate of a second cover plate type functions as the lower cover plate. For the second, opposite clamping block, a cover plate of the second cover plate type functions as an upper cover plate, and a cover plate of the first cover plate type functions as a lower cover plate. In each case two out of the total of four cover plates are thus identical and in the same plane in each case different cover plates face one another. The cover plate types then used are distinguished by implementation of the centering contour in two planes, wherein based on these two planes, different cover plates intermesh with one another in sections. Based on the precisely two cover plate types, a simplified manufacture of the tong system results, as well as a simplified stock-keeping.

For movable, flexible positioning of the means for adjusting the tong system, in particular of a cover plate, each clamping block has a spring device. In a special embodiment of the tong system, an abutment fixed to the clamping block, a spring mounting plate, and several spring mandrels that are arranged in parallel and fixed on one side on the spring mounting plate and are movable in relation to the abutment function as the spring device. As the spring elements within such a spring device, spring elements being mounted on one spring mandrel each, for example alternatingly layered disk springs or coil springs, are considered. The several spring mandrels mounted in parallel, especially in the same plane, advantageously effect stable guidance of the cover plate. Disk springs as the spring element are known to be able to withstand great force in a small installation space.

The approach presented here was previously described using the example of a complete tong system. The innovation is focused, however, on a clamping block or several similar clamping blocks in such a tong system. Thus, the invention is in general also a clamping block with means for use in a tong system as described here and below.

BRIEF DESCRIPTION OF THE DRAWING

Below an exemplary embodiment of the invention is explained in more detail with reference to the drawing. Objects or elements corresponding to one another are provided in all figures with the same reference numerals.

The or each exemplary embodiment is not to be understood as a limitation of the invention. Rather, within the scope of the present disclosure, changes and modifications are also possible, which for example through combination or alteration of individual features or method steps described in the general or special description part or contained in the claims and/or drawing that may be taken by a person skilled in the art to solve the problem and through combinable features lead to a new object or new method step or sequence of method steps also inasmuch as they pertain to operating methods.

Wherein

Figure 2:
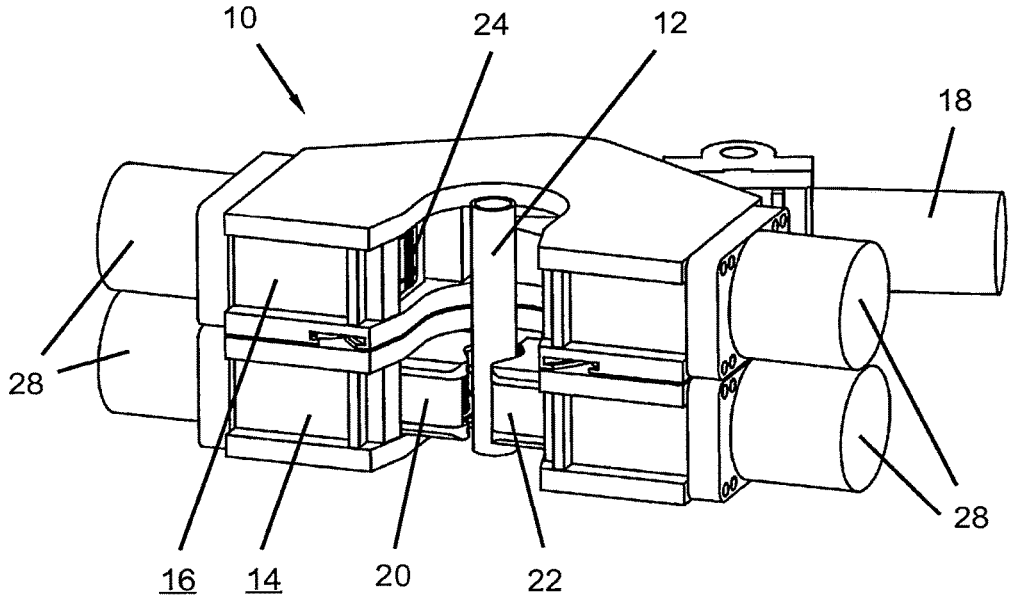
Figure 3A:
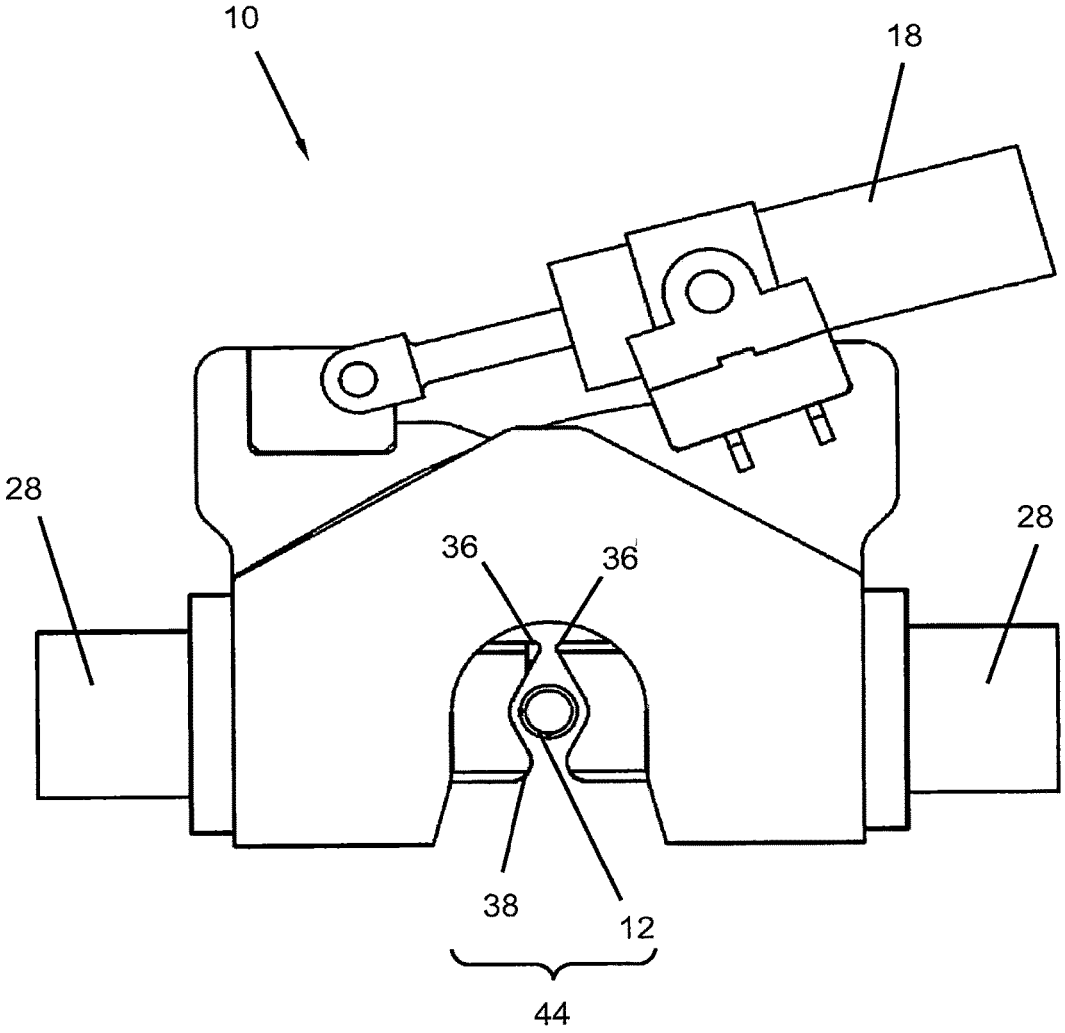
Figure 3B:
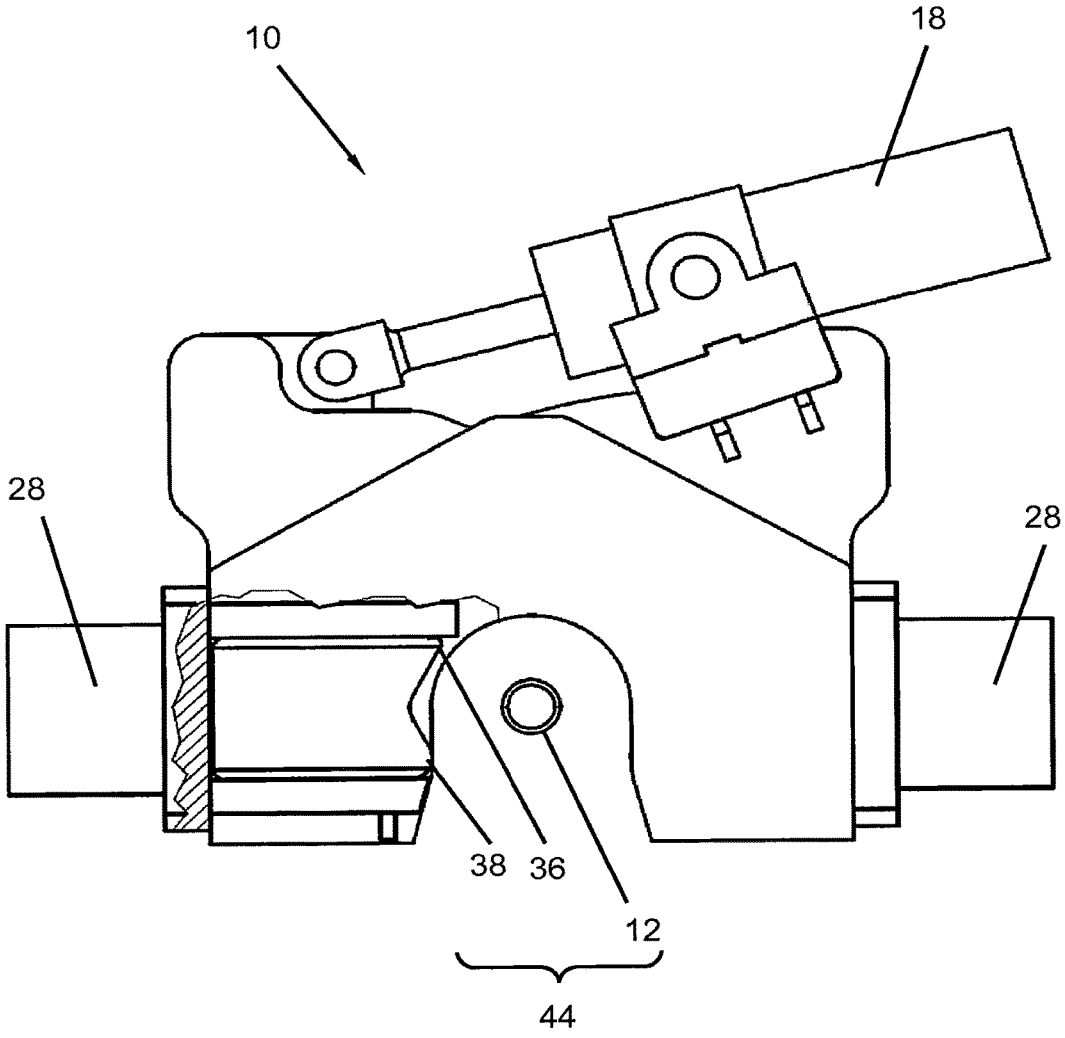
Figure 4:
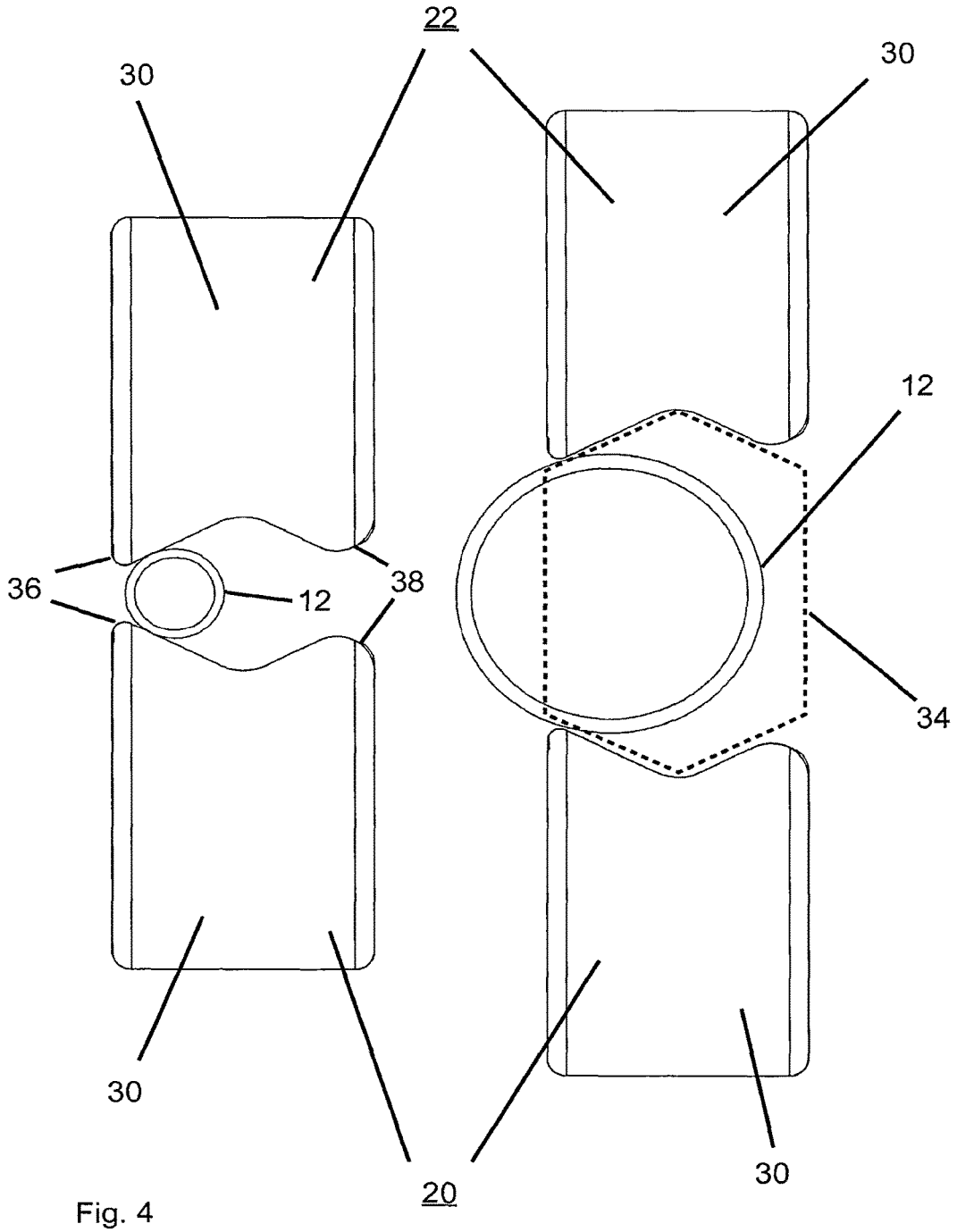
Figure 5:
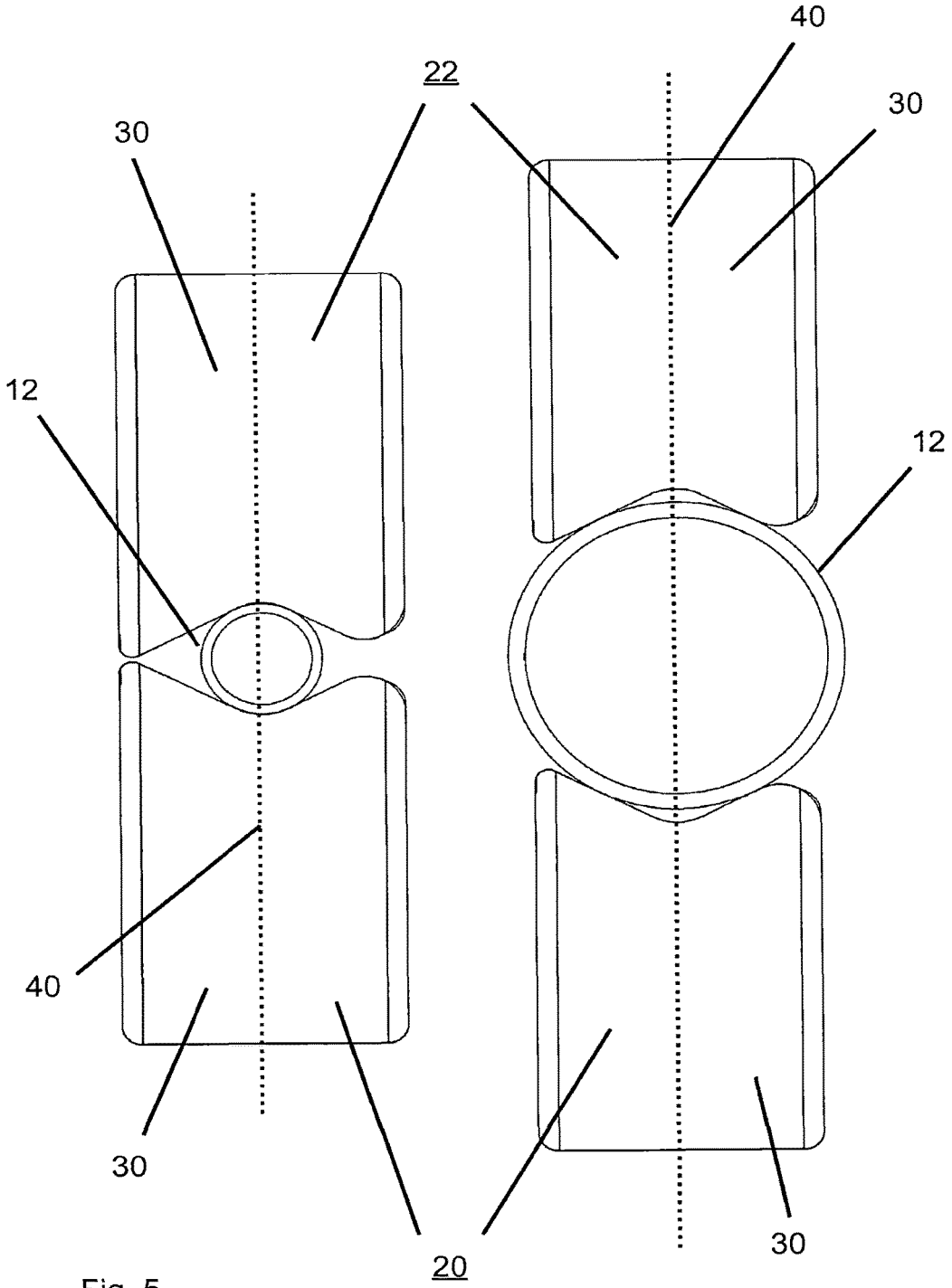
Figure 6:
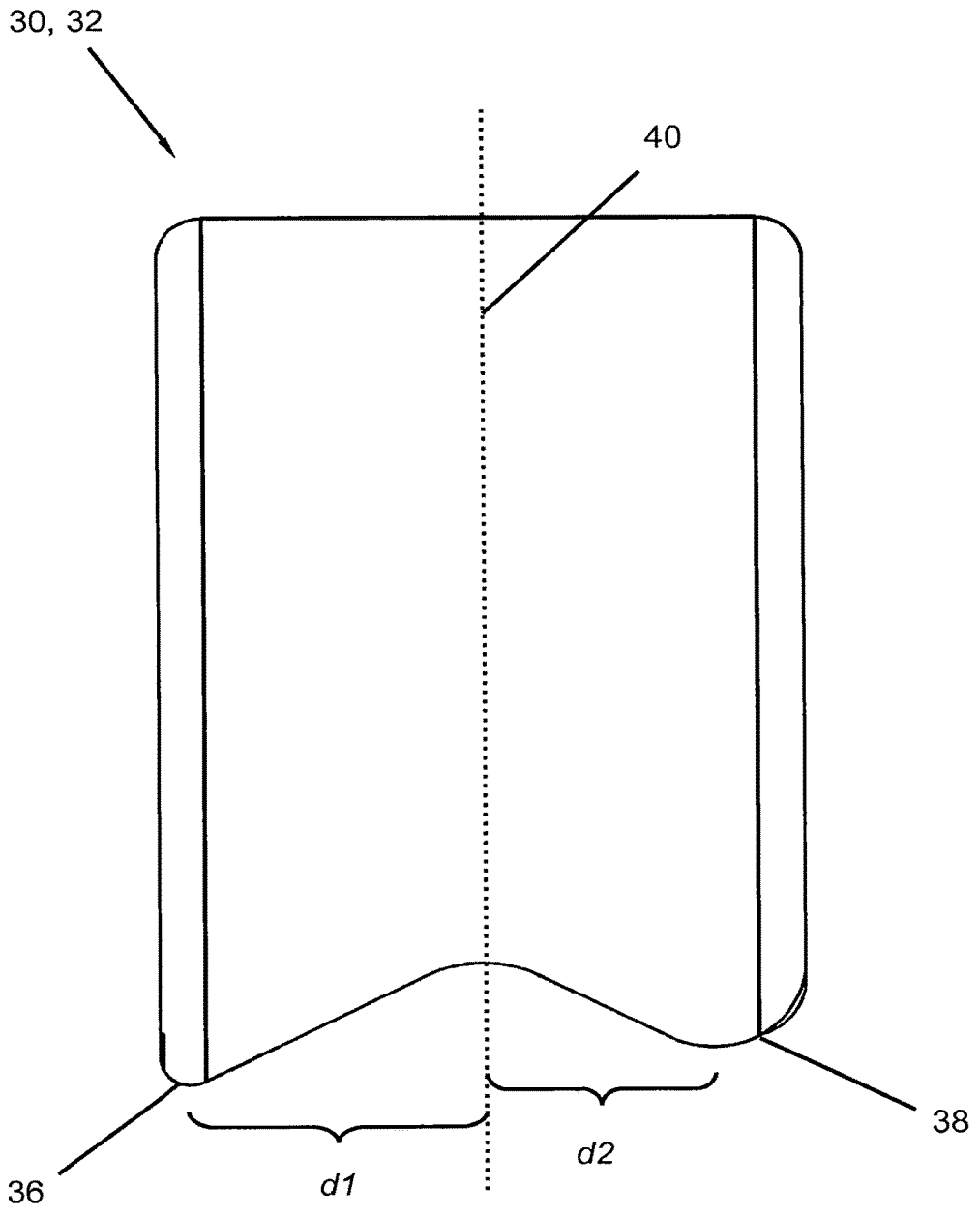
Figure 7:
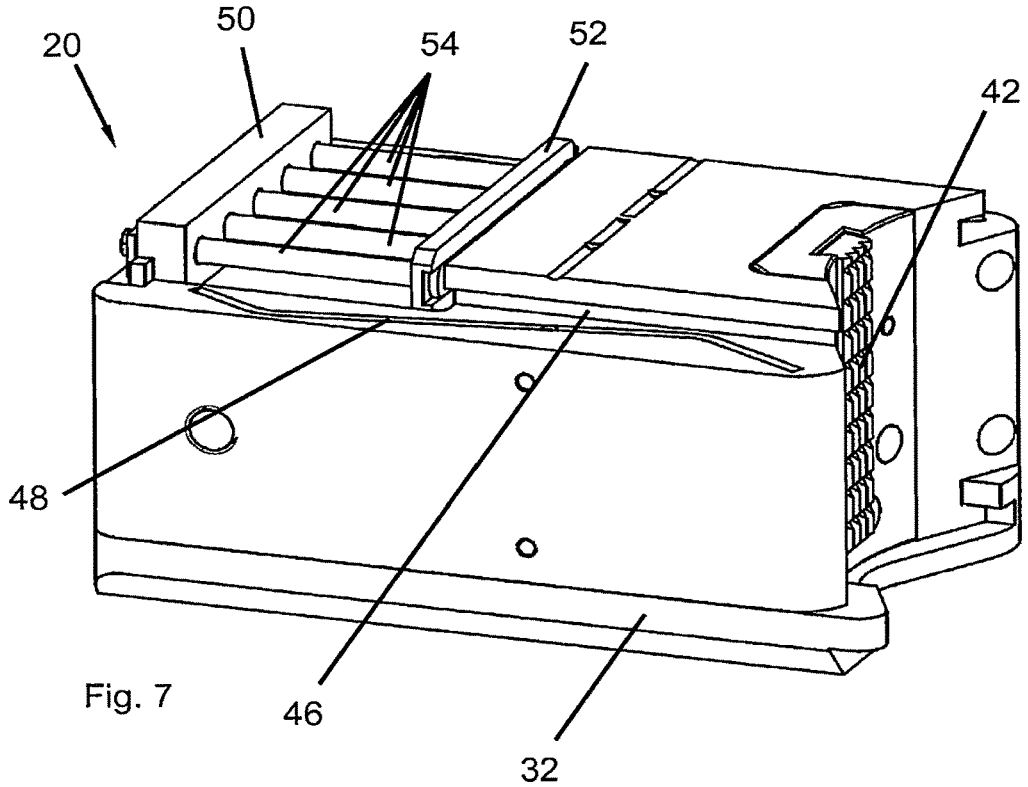
Figure 8:
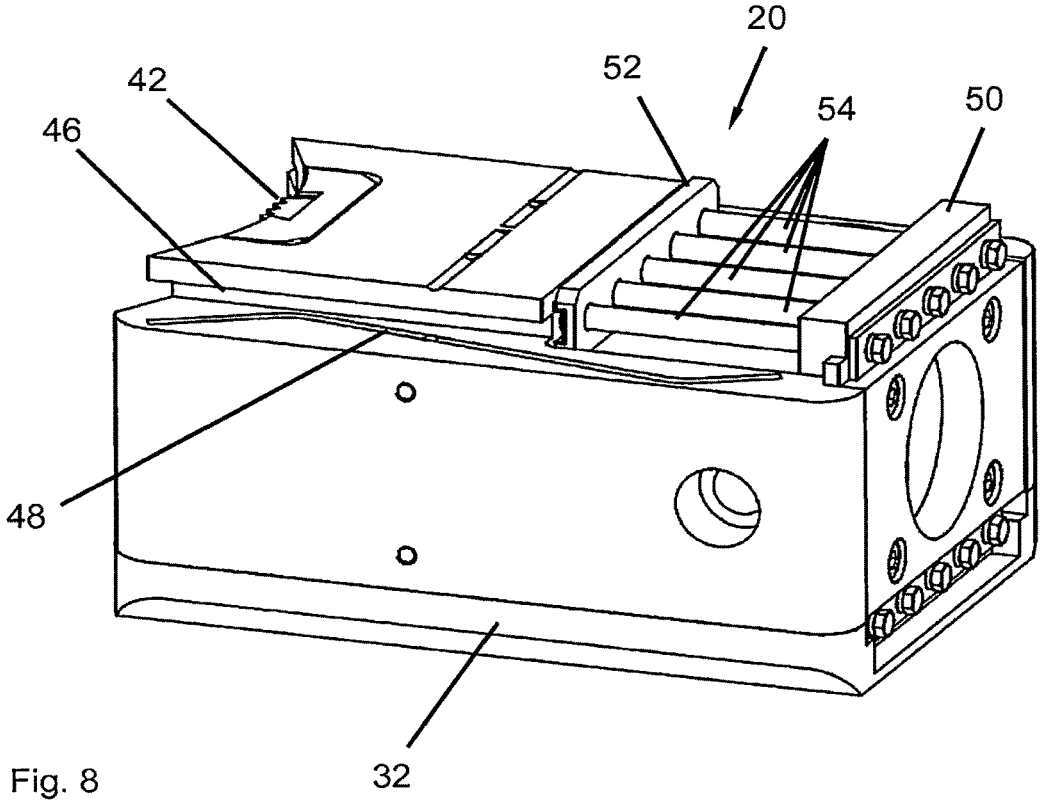
Figure 9:
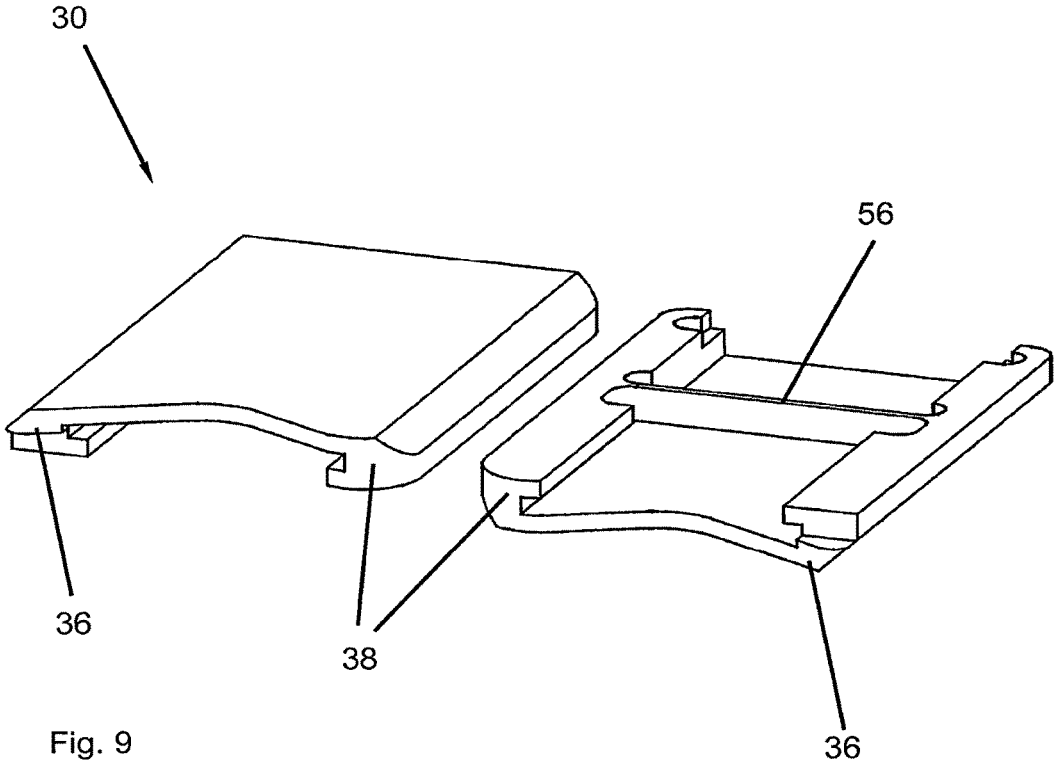
Figure 10:
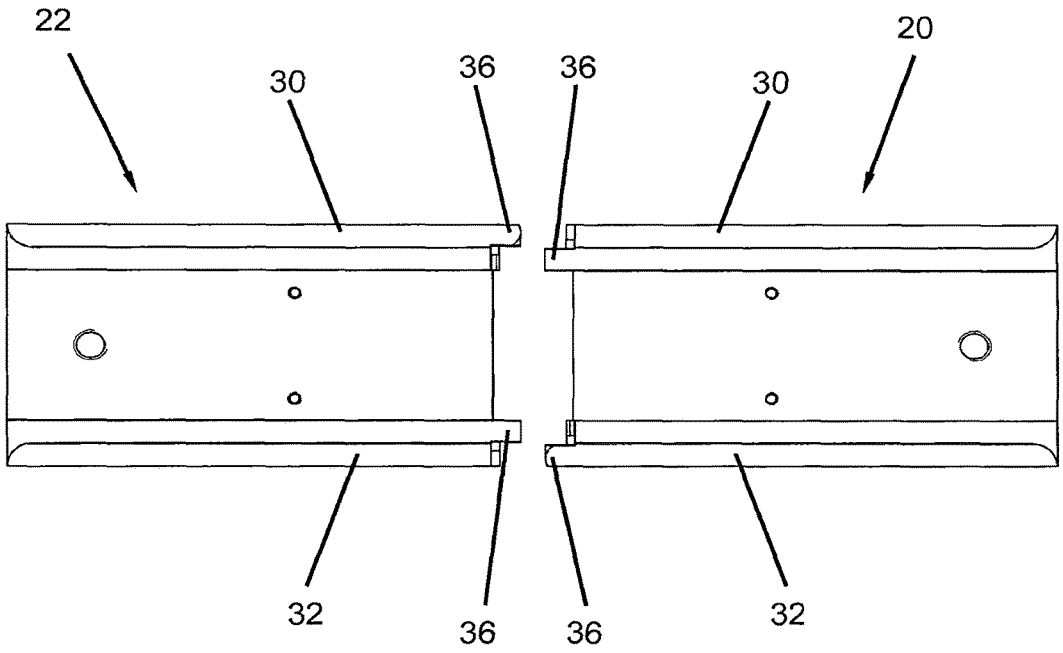
Figure 11:
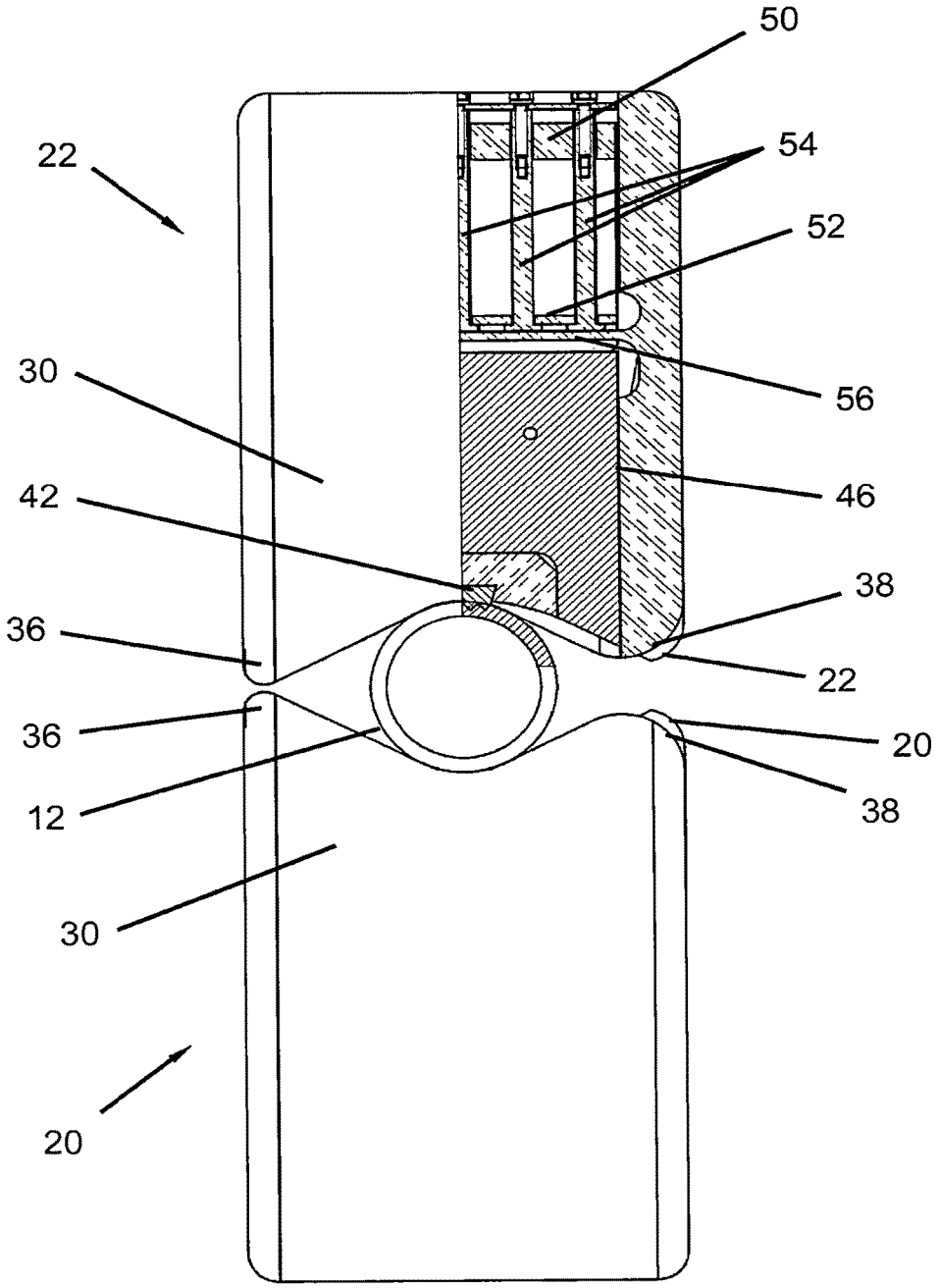
Figure 12:
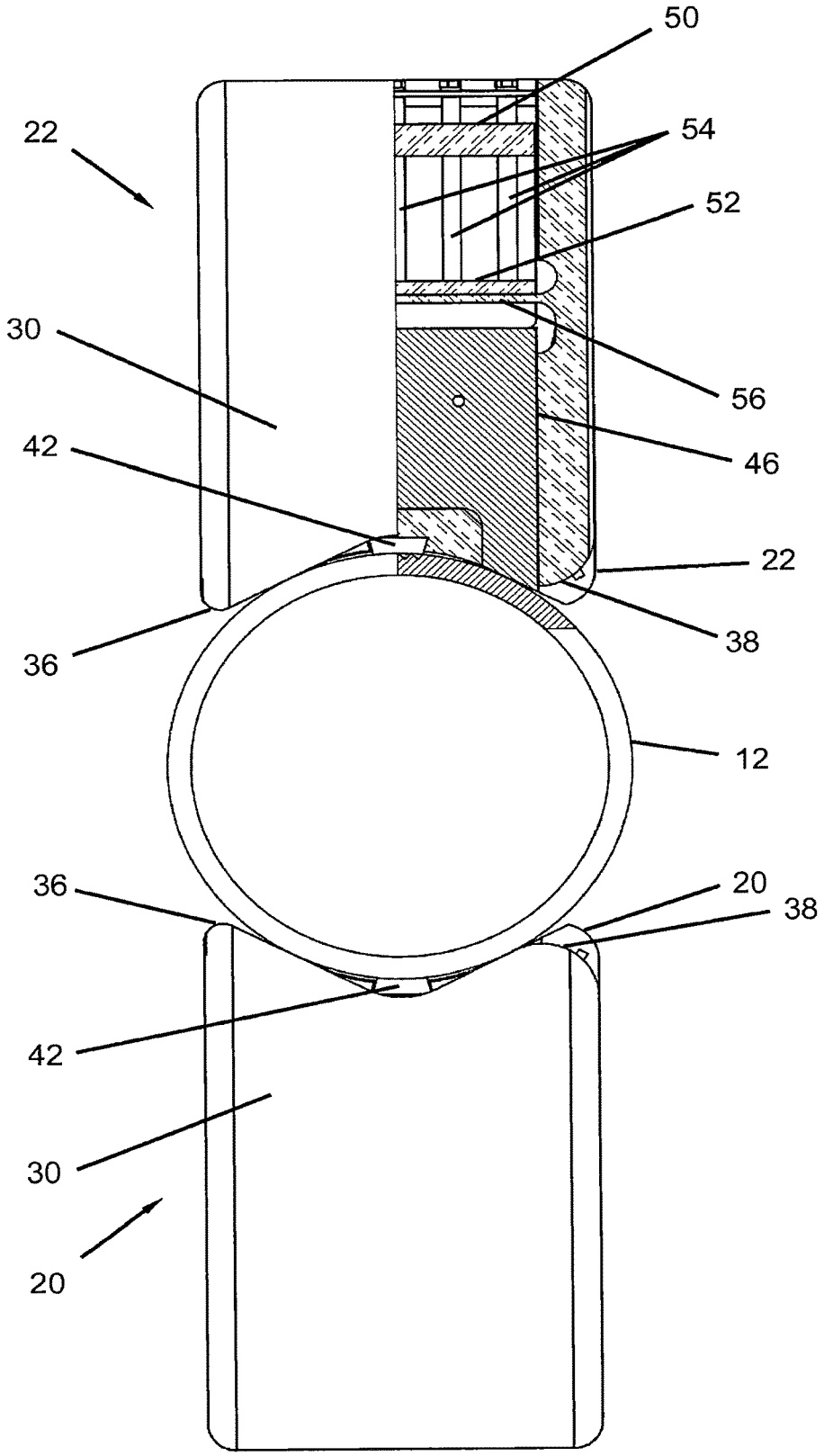

FIG. 1, FIG. 2, and FIG. 3A, 3B: show an embodiment of a concrete tong system in different views, FIG. 4 and FIG. 5: snapshots during grasping of a drill rod element by two of the clamping blocks of the tong system and during fixation to the drill rod element, FIG. 6: a top view of a cover plate of a clamping block provided for adjusting the tong system in relation to the drill rod element, FIG. 7 and FIG. 8: different views of a clamping block, FIG. 9: perspective views of a cover plate of the clamping block, FIG. 10: a side view of two clamping blocks with in each case two cover plates disposed thereon and translationally movable and FIG. 11 and FIG. 12: the two clamping blocks in configuration fixed to a drill rod element.

DETAILED DESCRIPTION OF ILLUSTRATED EMBODIMENTS

Figure 1:
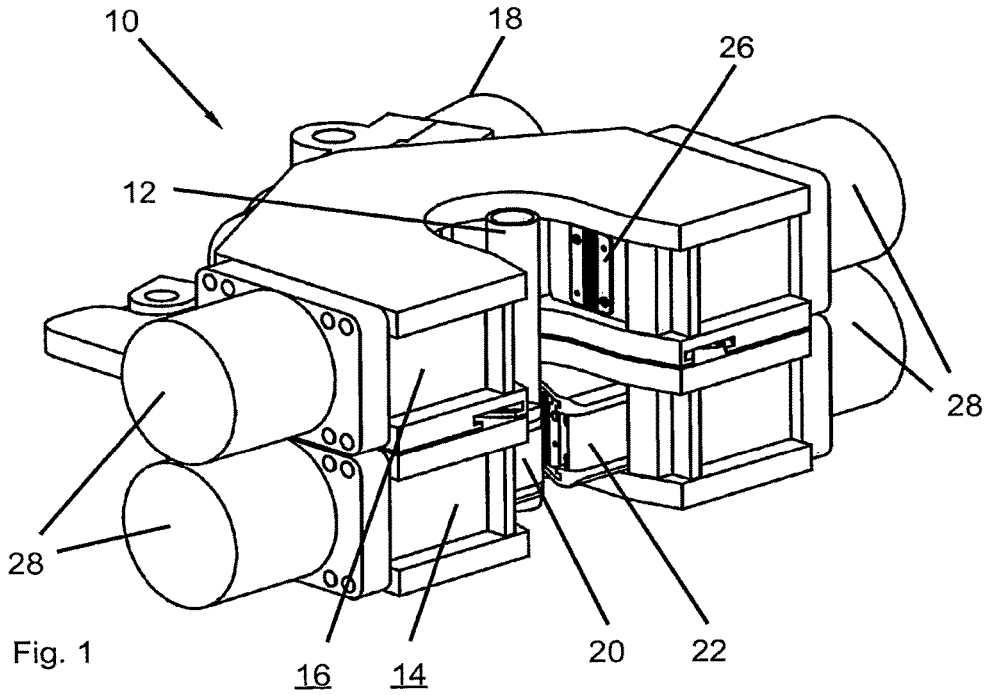

The depictions in FIG. 1 and FIG. 2 show isometric views from different viewing directions of an embodiment of a subject tong system 10, which is provided for use on the so-called drillfloor of a drill rig, itself not shown, intended for sinking of holes over hydrocarbon deposits for oil and gas exploration or geothermal exploitation. The depiction in FIGS. 3A and 3B shows the tong system 10 according to FIG. 1 and FIG. 2 in a top view.

The tong system 10 is part of an apparatus that in usual professional terminology for example is referred to as a "floorhand" or "iron roughneck." Such an apparatus in general and especially the tong system 10 is used when connecting and disconnecting of drill rod elements 12 for among other things screwing a drill rod element 12 onto the drill string. The drill rod elements 12 are connected during installation by screwing on in a manner that is known per se. Each drill rod element 12 for this purpose has, in a manner that is known per se, at one end a bushing that in the professional terminology is also designated as a "box," with an inner threading and at the other end a threading that may be screwed onto such a bushing and the inner threading therein, which in the professional terminology is also called a "pin." The contact area is also called in the professional terminology a tooljoint interface and is not especially emphasized in the depiction.

The tong system 10 comprises a lower tong 14 and an upper tong 16. The two tongs 14, 16 are rotationally movable in relation to one another by means of a drive unit 18 shown here as a hydraulic cylinder, so that by means of the tong system 10 a drill rod element 12 can be disconnected from the drill string or the drill rod element 12 can be connected to the drill string.

The lower tong 14 engages below the tool joint interface and thereby grips the drill rod element 12 which forms the upper end of the drill string and thus the stationary drill rod element 12. The upper tong 16 engages above the tool joint interface and accordingly grips the tool joint element 12 that is disconnected from or connected to the drill string.

For fixing the respective drill rod element 12 and for transmitting the power required during actuation of the thread, the tong system 10 has four clamping blocks 20, 22, 24, and 26, namely two clamping blocks 20, 22 facing/opposite one another in the lower tong 14 and two clamping blocks 24, 26 facing/opposite one another in the upper tong 16. The movement of each of the clamping blocks 20-26 is effected by means of a drive unit 28 here likewise shown as a hydraulic cylinder.

The following description relates to the clamping blocks 20, 22 of the lower tong 14. Basically, however, it is also considered that the clamping blocks 24, 26 of the upper tong 16 are designed identically to the clamping blocks 20, 22 of the lower tong 14 and accordingly such a variant of the tong system 10 should always be read into the following description.

For explaining the innovation proposed here, the depictions in FIG. 4 and FIG. 5 show the two clamping blocks 20, 22 of the lower tong 14 in the top view without the surrounding tong system 10. It is thereby shown that by means of the tong system 10 and the clamping blocks 20, 22 comprised therein, handling of drill rod elements 12 with different diameters is possible. In addition, it is shown that the clamping blocks 20, 22 have a profiled gripping side, wherein the gripping side of each clamping block 20, 22 faces the gripping side of the opposite clamping block 20, 22. The profiling is in the cover plates 30, 32 that are translationally movable on the clamping block 20, 22.

The two cover plates 30 that are visible in the top view in the depictions in FIG. 4 and FIG. 5 of the clamping block pair 20, 22 belonging to the lower tong 14 are the upper cover plates 30 of the respective clamping block 20, 22. A lower cover plate 22 is shown for example in the depiction in FIG. 7.

The profiling in the cover plates 30, 32 defines an inscribed prism 34, as shown for illustration only in the right depiction of FIG. 4. The profiling of each individual cover plate 30, 32 may be described by a middle or substantially middle notch and a lug 36, 38 to the right and left thereof. For the embodiment shown in the figures, one of the two lugs 36, 38 is longer than the other lug 36, 38 and the cover plates 30, 32 of the clamping blocks 20, 22 facing one another are oriented such that in each case two long lugs 36 and two short lugs 38 face one another.

The profiling and the side lugs 36, 38 ensure that a drill rod element 12 gripped during closure of two clamping blocks 20 facing one another is centered with respect to a central longitudinal axis 40 (FIG. 5) of the clamping blocks 20, 22. This is evident in a comparison of the depictions in FIG. 4 and FIG. 5. These in each case are snapshots taken during gripping (FIG. 4) of a drill rod element 12, wherein during closure of the clamping blocks 20, 22, adjustment of entire tong system 10 with respect to the drill rod element 12 follows, so that ultimately a central longitudinal axis 40 of the clamping blocks 20, 22 aligns or at least substantially aligns with the center of the drill rod element 12. This relative motion is also called centering below. After the closure of the clamping blocks 20, 22, the tong system 10 is centered over the stationary drill rod element 12 (FIG. 5). When the stationary drill rod element 12 for example in the mouse hole is still movable to some extent, it can also happen that the relative motion of the tong system 10 and the drill rod element 12 is substantially a movement of the drill rod element 12. Then as well this results in the mentioned centering.

The centering proceeds independently of a respective diameter of the drill rod element 12, as is likewise illustrated in the depictions in FIG. 4 and FIG. 5. Based on the centering, the respectively gripped drill rod element 12 is finally located in front of a gripping surface 42 (FIG. 7, 8) in the central front of each clamping block 20, 22, which gripping surface in the professional terminology is occasionally also called the knife. The profile or the contour of the cover plates 30, 32 can accordingly also be called the centering profile of the centering contour.

The components of the centering contour, namely the two lugs 36, 38—in particular but not exclusively two lugs in an embodiment with a long lug 36 and a short lug 38—are hereby connected integrally to the cover plate 30, 32.

To explain the advantage of the design of the cover plates 30, 32 with the long and short lugs 36, 38, reference is made to the depiction of the tong system 10 in FIG. 3A. With reference to the top view of the tong system 10 shown there, it can be seen that the short lugs 38 uncover an opening 44 of the operating region of the tong system 10 as widely as possible. The depiction in FIG. 3 shows a snapshot with nearly closed, thus nearly maximally deployed clamping blocks 20, 22.

In the retracted state (FIG. 3B), the clamping blocks 20, 22 are withdrawn under the bearing structure of the tong system 10 or at least substantially withdrawn under the bearing structure, so that the opening 44 of the tong system 10 is uncovered as much as possible, as is shown in the depiction in FIG. 3B with the outbreak there from the bearing structure. Thus the tong system 10 can also draw close enough to drill rod elements 12 with very large diameters that it is possible to grip them. At any rate the short lugs 38 do not impede the approach of the tong system 10 to the drill string and the respective upper drill rod element 12.

The long lugs 36 on the other hand ensure that gripping of a drill rod element 12 and later centering are also possible when the tong system 10 basically has approached too close to the drill string and the upper drill rod element 12. Then the drill rod element 12 is in a rear section working range facing away from the opening 44 and can also still be gripped there by the long lug 36.

The long lugs 36 differ here from the short lugs 38 not only in their length for example measured along the longitudinal extent of the cover plate 30, 32, but also with respect to their contour. The shorter length of the short lugs 38 in the depicted embodiment is due to a larger diameter of an arcuate edge contour of the tip there in comparison with the long lug 36. Accordingly, the long lug 36—with the small diameter of the edge contour of the tip there—tapers more. Each lug 36, 38 with its side surface facing the central longitudinal axis 40 of the cover plate 30, 32 can grip and center a drill rod element 12. The effective length d1, d2 of these side surfaces starts at the apex point of the respective tip and is therefore for the long lug 36 larger than the short lug 38, as is shown for illustration in the depiction in FIG. 6.

The depictions in FIG. 7 and FIG. 8 show from different viewing directions isometric views of an embodiment of a clamping block 20 without the upper cover plate 30. The clamping block 20 has the already mentioned gripping surface 42 on its gripping side (knife). By means of a translational movement of the clamping block 20 inside the tong system 10, the gripping surface 42 abuts the outer surface of a drill rod element 12 centered by means of the cover plates 30, 32 and the centering profile there. The respective upper drill rod element 12 of the drill string is gripped and fixed by means of a translational motion of the two clamping blocks 20, 22 of the lower tong 14. Based on the subsequent centering, namely the centering of the lower tong 14 with the two clamping blocks 20, 22 in relation to the stationary drill string in the borehole, the tong system 10 is generally aligned over the borehole in relation to the stationary drill rod element 12. The tong system 10 is suitably mounted for this purpose, for example suspended from a rotationally and/or translationally movable arm. The suspension here is effected such that even with an arm immobilized after initial movement, adjustment/centering of the tong system 10 is possible. For this purpose for example an articulated suspension in two parallel axes may be considered.

Based on the upper cover plate 30 removed for the depiction in the FIGS. 7 and 8, a guide bearing formed in a (front) section facing toward the gripping surface 42, in the form of two side guide grooves 46 for translationally displaceable positioning of the upper cover plate 30, is discernible. In a surface of the clamping block 20, on which the cover plate 30 then slides along the guide grooves 46, a lubricating groove 48 is formed. The bearing of the lower cover plate 32 is then identically designed and the cover plates 30, 32 have a corresponding positive locking contour for displacement interaction with the guide grooves 46, as is shown in the depiction in FIG. 9.

For resilient bearing of the cover plate 30, there is a spring device behind the guide bearing connecting in the same plane. This comprises an abutment 50 fixed to the base body of the clamping block 20 as well as a spring support plate 52 spring-mounted thereon. In the shown embodiment the spring bearing is implemented by means of a number of spring mandrels 54 arranged in parallel and fixed to one side of the spring support plate 52 that are movable in relation to the abutment 50. The spring elements for example may be disk springs, not shown here, alternately layered one on each spring mandrel 54. Alternatively, the spring elements may also be coiled springs also mounted one on each spring mandrel 54. The position shown in FIG. 7 and FIG. 8 of the spring support plate 52 corresponds to a cover plate 30 maximally extending over the gripping surface of the clamping block 20. In this position the cover plate 30 is fully extended. This position is the unloaded position of the cover plate 30 and accordingly the position of the cover plate 30 during initial closure of the clamping blocks 20, 22.

For activation by means of the spring device, the cover plate 30 has a web plate 56 (FIG. 9) on the inside. The lower cover plate 30 is identically designed in this regard. The spring support plate 52 lies against the web plate 56 and for the position of the spring support plate 52 shown in FIG. 7 and FIG. 8, a gap remains between the spring device and the spring support plate 52 as its forwardmost part on the one hand, and the guide bearing with the side guide grooves 46 on the other, which at least allows accommodation of the web plate 56.

During closure of the two opposite clamping blocks 20, 22 within the tong system 10, if these come in contact with a drill rod element 12, this contact initially occurs with the centering contour of the cover plates 30, 32. The depictions in FIG. 4 are a snapshot of such a first contact. With further closure of the clamping blocks 20, 22 of the lower tong 14, the respectively gripped section of the drill rod element 12 slides on the long lug 36 or on the short lug 38 in the direction of the notch of the centering contour. If the gripped drill rod element 12 for example as a component of the drill string is stationary, the tong system 10 moves in relation to the drill rod element 12.

At the latest, when the position of the tong system 10 over the borehole is adjusted such that the gripped section of the drill rod element 12 is in the notch of the centering contour, centering of the tong system 10 in relation to the drill rod element 12 is achieved, the cover plates 30, 32 retract under ongoing contact with the drill rod element 12 for further closure of the clamping blocks 20, 22. Based on the force exerted by the spring device, this ensures that the achieved adjustment of the tong system 10 over the borehole persists. When the cover plates 30, 32 are deflected, the opposite gripping surfaces 42 of the clamping blocks 20, 22 of the lower tong 14 engage with the gripped section of the drill rod element 12 and the tong system 10 is fixed to the drill rod element 12 connected to the drill string.

The spring devices for the spring bearing of the upper and lower cover plate 30, 32 here allow independent translational displaceability of the two cover plates 30, 32 and thus also independent deflection of each cover plate 30, 32. This is expedient provided that the section of the drill rod element 12 gripped by the clamping blocks 20, 22 is in the region of the transition from a normal diameter of the drill rod element 12 to an increased diameter in the region of the tooljoint. The independent spring bearings of the cover plates 30, 32 then ensure that each cover plate 30, 32 during closure of the clamping blocks 20, 22 remains continuously in contact with the drill rod element 12 and thus is effective for adjusting the tong system 10.

The depiction in FIG. 10 shows the two clamping blocks 20, 22 without the surrounding tong system 10 in a side view. Here it is evident that each cover plate 30, 32 has the centering contour in two planes and that a sequence of planes of the centering contour in the two cover plates 30, 32 of one of the two clamping blocks 20 and a sequence of planes of the centering contour in the two cover plates 30, 32 of the opposite clamping block 22 allows a form-fit connection of the planes of the centering contour. This makes possible, in particular in the region of the long lug 36 (cf also FIG. 9) further closure of the clamping blocks 20, 22 than would be possible without such a configuration of the centering contour. The possibility thereby achieved of further closure of the clamping blocks 20, 22 allows handling also of drill rod elements 12 with a very small diameter. Nonetheless, in the embodiment of the cover plates 30, 32 shown, only cover plates of the first and second cover plate type are needed, since a cover plate 30 that functions as an upper cover plate 30 in one of the clamping blocks 20, is usable in the opposite clamping block 22 as a lower cover plate 32 and vice versa.

The depictions in FIG. 11 and FIG. 12 show—partly in sections—the two clamping blocks 20, 22 of the lower tong 14 in a configuration fixed to a drill rod element 12. The cover plates 30, 32 are deflected according to the diameter of the respective gripped drill rod element 12, so that the gripping surfaces 42 of the two clamping blocks 20, 22 lie on the outside circumferential surface of the drill rod element 12. In this way the fixation of the tong system 10 on the whole to the drill rod element 12 is achieved. One can identify the deflected state of the cover plates 30, 32 from the position of the web plate 56, with the guide grooves 46 formed therein, in relation to the guide bearing lying to the front in the direction of the gripping surface 42. The depiction in FIG. 12 shows a maximally or substantially maximally deflected configuration of the cover plates 30, 32. The depiction in FIG. 11 with the drill rod element 12 with a smaller diameter gripped therein shows in comparison a less widely deflected configuration of the cover plates 30, 32. After fixation of the clamping blocks 20, 22 to the drill rod element 12, the cover plates 30, 32 in their centering contour no longer participate in the further course of movement in tightening or loosening the threaded connection, at least not in the transmission of the torques operating in the process, which are transmitted solely via the gripping surfaces 42.

A few aspects in the description presented here can be summarized briefly as follows: a tong system 10 is provided for connecting a drill rod element 12 to an often stationary drill rod element 12 or for disconnecting the drill rod element from another drill rod element 12, wherein the tong system 10 comprises at least two clamping blocks 20, 22 that face one another and are provided for fixation of the tong system 10 to the stationary drill rod element 12, wherein at least one clamping block 20, 22 has movable means 30, 32, with a centering contour, effective for adjusting the tong system 10 in relation to the fixed drill rod element 12, wherein the or each means 30, 32 provided for adjusting the tong system 10 in relation to the stationary drill rod element 12 comprises a centering contour with a central notch and two side lugs 36, 38, in particular in the form of two lugs 36, 38 connected integrally to the means functioning as a carrier of the centering contour, as well as a clamping block 20, 22 as a component of such a tong system 10.

LIST OF REFERENCE NUMERALS

10 tong system
12 drill rod element
14 lower tong
16 upper tong
18 drive unit
20-26 clamping block
28 drive unit
30 (upper) cover plate

32 (lower) cover plate
34 prism
36 (long) lug
38 (short) lug
40 central longitudinal axis
42 gripping surface
44 opening (of the tong system)
46 guide groove
48 lubrication groove
50 abutment
52 spring support plate
54 spring mandrel
56 web plate

The invention claimed is:

1. A tong system (10) for connecting a drill rod element (12) to a stationary drill rod element (12) or for disconnecting a drill rod element from a stationary drill rod element (12), the tong system (10) comprising:

at least two clamping blocks (20, 22) provided for fixing the tong system (10) to the stationary drill rod element (12), wherein each clamping blocks (20, 22) is movable and has a gripping surface (42) on a gripping side; and a drive unit (28) moving the at least two clamping blocks (20, 22), wherein:

at least one clamping block (20, 22) comprises a movable member (30, 32), independent from the gripping surface (42), and having a centering contour, effective for adjusting the tong system (10) in relation to the stationary drill rod element (12) with the centering contour, the movable member (30, 32) comprises a central notch and two side lugs (36, 38) to define the centering contour, and the movable member (30, 32) is translationally movable by the drive unit in relation to the clamping block (20, 22).

2. The tong system (10) according to claim 1, wherein the side lugs (36, 38) includes a long lug (36) with an arcuate edge contour on one side of the central notch and a short lug (38) with an arcuate edge contour on another side of the central notch, wherein the radius of the arcuate edge contour of the long lug (36) is smaller than the radius of the arcuate edge contour of the short lug (38).

3. The tong system (10) according to claim 2, wherein the movable member comprises two translationally movable cover plates (30, 32) that are spring mounted effective for adjusting the tong system (10) in relation to the stationary drill rod element (12).

4. The tong system (10) according to claim 3, wherein each cover plate (30, 32) has the centering contour in two planes, wherein a sequence of planes of the centering contour in the two cover plates (30, 32) of a clamping block (20, 22) as well as a sequence of planes of the centering contour in the two cover plates (30, 32) of an opposite clamping block (20, 22) allows a positive connection of the planes of the centering contour.

5. The tong system (10) according to claim 4, wherein the two cover plates (30, 32) includes a first cover plate type and a second cover plate type, wherein in a first clamping block (20) an upper cover plate (30) is of the first cover plate type and a lower cover plate (32) is of the second plate type, and wherein in a second clamping block (22) arranged opposite the first clamping block (20), the upper cover plate (30) is of the second cover plate type and the lower cover plate (32) is of the first cover plate type.

6. The tong system (10) according to claim 1, wherein the movable member comprises at least one translationally movable cover plate (30, 32) effective for adjusting the tong system (10) in relation to the stationary drill rod element (12).

7. The tong system (10) according to claim 6, wherein the at least one cover plate (30, 32) is spring-mounted.

8. The tong system (10) according to claim 6, wherein the movable member of each clamping block (20, 22) comprises two cover plates (30, 32).

9. The tong system (10) according to claim 8, wherein each cover plate (30, 32) has the centering contour in two planes, wherein a sequence of planes of the centering contour in the two cover plates (30, 32) of a clamping block (20, 22) as well as a sequence of planes of the centering contour in the two cover plates (30, 32) of an opposite clamping block (20, 22) allows a positive connection of the planes of the centering contour.

10. The tong system (10) according to claim 9, wherein the two cover plates (30, 32) includes a first cover plate type and a second cover plate type, wherein in a first clamping block (20) an upper cover plate (30) is of the first cover plate type and a lower cover plate (32) is of the second plate type, and wherein in a second clamping block (22) arranged opposite the first clamping block (20), the upper cover plate (30) is of the second cover plate type and the lower cover plate (32) is of the first cover plate type.

11. The tong system (10) according to claim 1, wherein each clamping block (20, 22) comprises a spring device (50, 52, 54) providing a movable bearing for adjusting the tong system (10).

12. The tong system (10) according to claim 11, wherein the spring device (50, 52, 54) comprises an abutment (50) fixed at the clamping block (20, 22), a spring support plate (52) spring-mounted on the abutment (50), several spring mandrels (54) movable in relation to the abutment (50), arranged in parallel, and fixed on one side to the spring support plate (52), and spring elements comprising alternately layered disk springs, each on one spring mandrel (54).

13. A clamping block (20, 22) for use in a tong system (10), movable by a drive unit (28), for connecting a drill rod element (12) to a stationary drill rod element (12) or for disconnecting a drill rod element from a stationary drill rod element (12), the clamping block (20, 22) comprising:

a gripping surface (42) on a gripping side;

a movable member (30, 32), independent from the gripping surface (42), and having a centering contour, effective for adjusting the tong system (10) in relation to the stationary drill rod element (12) with centering contour, wherein the movable member (30, 32) comprises a central notch and two side lugs (36, 38) to define the centering contour, and the movable member (30, 32) is translationally movable in relation to the clamping block (20, 22).

14. The clamping block (20, 22) according to claim 13, wherein side lugs (36, 38) includes a long lug (36) with an arcuate edge contour on one side of the central notch and a short lug (38) with an arcuate edge contour on another side of the central notch, wherein the radius of the arcuate edge contour of the long lug (36) is smaller than the radius of the arcuate edge contour of the short lug (38), and wherein the movable member comprises two translationally movable cover plates (30, 32) that are spring mounted effective for adjusting the tong system (10) in relation to the stationary drill rod element (12).

15. The clamping block (20, 22) according to claim 14, wherein each cover plate (30, 32) has the centering contour in two planes, wherein a sequence of planes of the centering contour in the two cover plates (30, 32) of a clamping block (20, 22) as well as a sequence of planes of the centering contour in the two cover plates (30, 32) of an opposite clamping block (20, 22) allows a positive connection of the planes of the centering contour.

* * * * *